United States Patent [19]

Delang

[11] 3,974,956

[45] Aug. 17, 1976

[54] PACKAGING AND DISPENSING CARTON

[75] Inventor: Theodore G. Delang, Eric, Pa.

[73] Assignee: American Sterilizer Company, Eric, Pa.

[22] Filed: Dec. 30, 1975

[21] Appl. No.: 645,411

[52] U.S. Cl. ..... 229/20; 229/9; 229/44 CB

[51] Int. Cl.[2] ..... B65D 5/38

[58] Field of Search ..... 229/19, 20, 9, 10, 11, 229/44 CB; 40/126 R, 126 A; 206/267, 273, 248, 271

[56] References Cited

UNITED STATES PATENTS

| | | | |
|---|---|---|---|
| 1,185,560 | 5/1916 | Walcutt | 229/20 |
| 1,953,418 | 4/1934 | MacDonald | 229/111 |
| 1,955,633 | 4/1934 | Hill | 229/9 |
| 1,994,540 | 3/1935 | Spiking | 229/11 X |
| 2,950,060 | 8/1960 | Von Rudeen | 229/20 UX |
| 3,023,242 | 2/1962 | Ringler | 229/19 X |
| 3,773,245 | 11/1973 | Meyers et al. | 229/20 |

*Primary Examiner*—Davis T. Moorhead

[57] ABSTRACT

A carton and sleeve combination is disclosed. When the carton is closed, it can be used as a container to package. dispense or display a product. The sleeve receives the carton and, when the top of the carton is open, the sleeve may be slid down and the carton becomes a free-standing dispenser for displaying the product from the top of the carton. As the sleeve is moved downward on the carton, the two opposite sides flare outward to form a wide solid base for an otherwise unstable box. A tab on the sleeve engages a slot in the side of the carton to lock the sleeve in position. The sloping sides forming the base may be used as graphic display panels.

7 Claims, 5 Drawing Figures

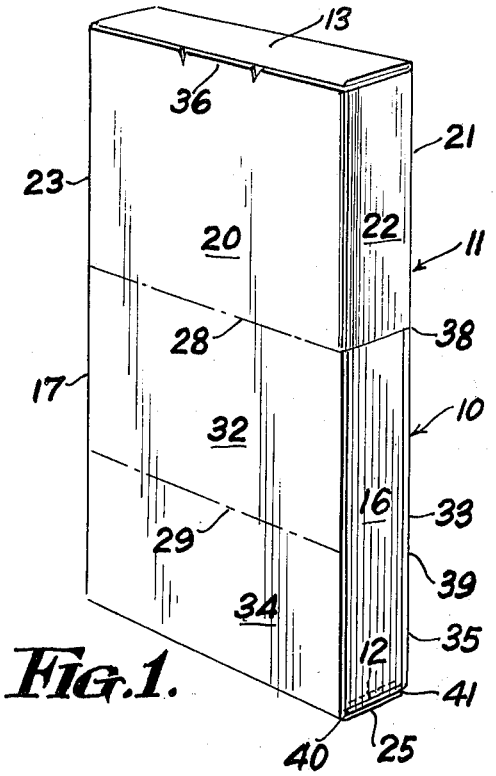
FIG. 1.
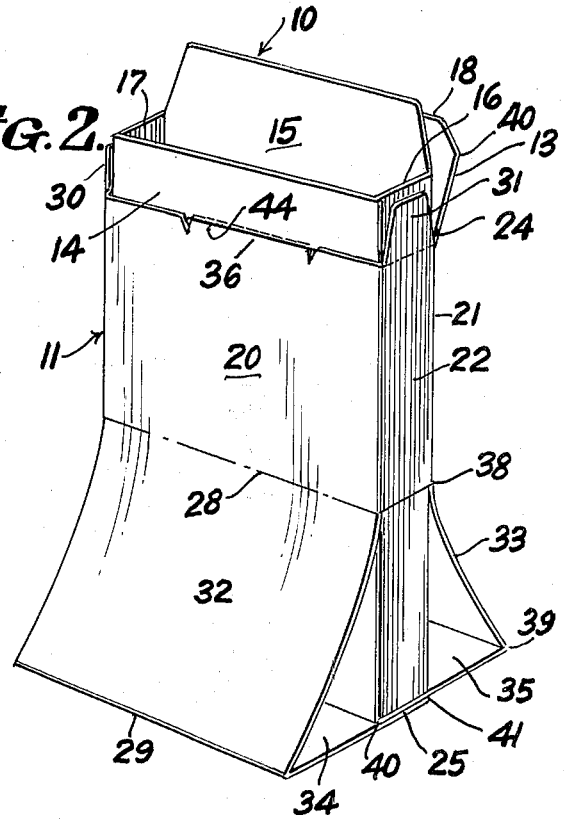
FIG. 2.
FIG. 3.
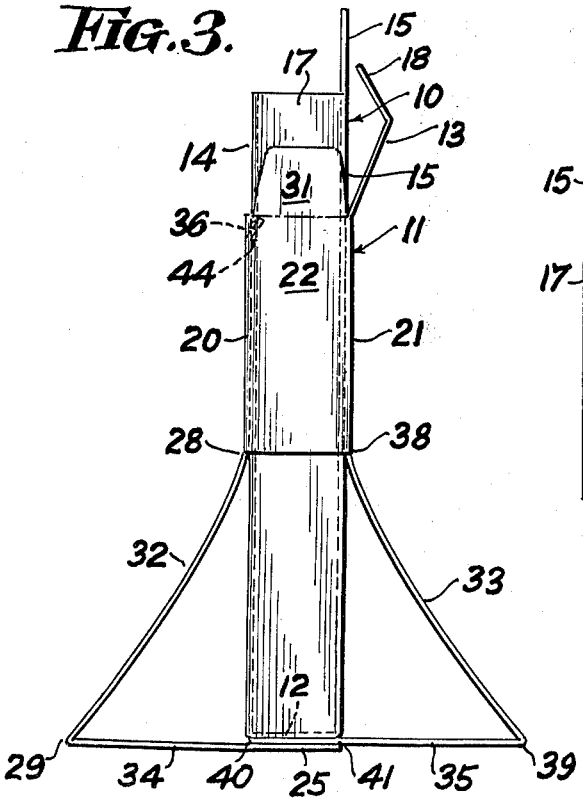
FIG. 4.
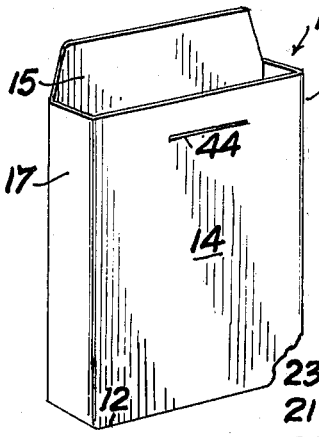
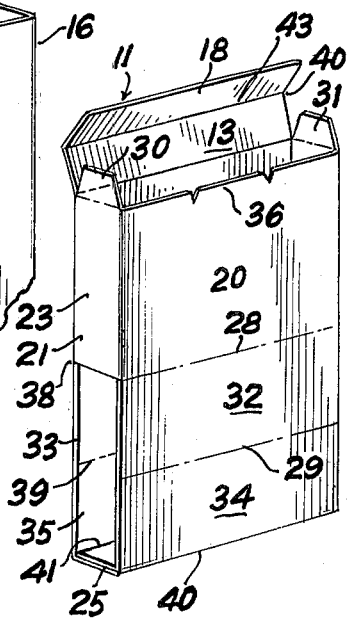
FIG. 5.

PACKAGING AND DISPENSING CARTON

REFERENCES TO PRIOR ART

Prior art of interest: U.S. Pat. Nos. 1,185,560; 1,953,418; 2,919,845 and 3,067,925.

OBJECTS OF THE INVENTION

It is an object of the invention to provide an improved carton. Another object of the invention is to provide an improved carton and folding support sleeve. Another object of the invention is to provide a display carton that is simple in construction, economical to manufacture and simple and efficient to use.

With the above and other objects in view, the present invention consists of the combination and arrangement of parts hereinafter more fully described, illustrated in the accompanying drawing and more particularly pointed out in the appended claims, it being understood that changes may be made in the form, size proportions and minor details of construction without departing from the spirit or sacrificing any of the advantages of the invention.

GENERAL DESCRIPTION OF DRAWINGS

FIG. 1 is a view of the carton and sleeve in position for packaging a product.

FIG. 2 is an isometric view of the carton with the sleeve slid down to position for supporting the carton to dispense or display the product.

FIG. 3 is a side view of the carton supported as shown in FIG. 2.

FIG. 4 is a view of the carton removed from the sleeve to a different proportion than the other figures.

FIG. 5 is a view of the sleeve with the carton removed.

DETAILED DESCRIPTION OF DRAWINGS

Now, with more particular reference to the drawings, in FIG. 1 the carton 10 is snugly received in the sleeve 11. The carton may be made of cardboard or other suitable material, and the carton is generally rectangular in shape and thin relative to its width so that it would be unstable if stood on end. The carton 10 is suitable for use to package, dispense or display products as shown in FIG. 4. It is an open-topped box with its rear side extending above the front. The carton 10 has a flat end 12, a flat front 14 and a flat rear side 15, and two side edges 16 and 17. The rear side 15 extends up above the front 14 and terminates approximately flush with the upper edge of the sleeve when the sleeve is moved up as shown in FIG. 1. A slot 44 is formed in the front wall 14 for receiving the tab 36 of the sleeve as will be explained hereinafter.

The sleeve 11 is slidably supported on the carton and adapted to slide from a position adjacent the top end shown in FIG. 1 to a position intermediate the ends as shown in FIGS. 2 and 3. The tubular part of the sleeve 11 as shown, has a length slightly less than half the length of the carton but it could be any suitable length depending on the particular application and the taste of the particular designer.

In FIGS. 1, 2 and 3, three panels 20, 32 and 34 are integrally connected together and panels 21, 33 and 35 and the upper layer of end 25 are integrally connected together. The sides 22 and 23 of sleeve 11 terminate at 38 and the edges 16 and 17 of carton 10 are exposed through the openings below edges 22 and 23. The overlapping ends of panels 34 and 35 extend across the bottom of the panel preferrably scored at 29, 39, 40 and 41 for convenience in bending the material. The panels 32 and 33 are adapted to swing outwardly from the carton at the lower ends of the panels at lines 28 and 39, the panels 25, 34 and 35 resting on a supporting surface to hold the carton in a stable, upright position.

The upper end of the sleeve is open and a flap 13 is integrally connected to the back 21 and tab 18 is connected to flap 13 along score line 40. Ears 30 and 31 are fixed to edges 22 and 23 and fold inwardly when the carton is closed. When in the position shown in FIG. 1, the sleeve surrounds the upper end of the box. The sleeve has integrally connected side panels 32 and 33 swingably connected thereto along scored lines 28 and 38 respectively and side panels 34 and 35 are integrally connected to side panels 32 and 33 along scored lines 29 and 39 respectively. The end member 25 is integrally connected to the side panels 34 and 35 along score lines 30 and 41 respectively. When in position shown in FIG. 1, the lower end 12 of the carton rests on end 25 of the sleeve and the sides and panels 20, 32 and 34 are disposed in a single plane parallel to the plane of the carton. Sides 20, 32 and 34 are coextensive with the front 15 of the carton. When the flaps 32 and 33 are swung outward to the position in FIGS. 2 and 3, the sleeve 11 is slid downward and the side panels 32 and 33 swing outward forming a stable base of the carton.

The panels 25, 34 and 35 comprise means for connecting the distal ends 29 and 39 of the panels together to limit the distance that the panels 32 and 33 can swing outwardly from the carton. The lower end 12 of the carton rests on the panel 25 and is fixed to it by adhesive, stapling, or the like and the carton is prevented from tipping laterally by panels 32 and 33. Tab 36 is integrally fixed to the upper edge of the front side 20 and extends upwardly therefrom and is received in the slot 44 of the sleeve when the carton and sleeve are assembled in the position shown in FIGS. 2 and 3.

When the sleeve is pushed down to the position shown in FIGS. 2 and 3 for displaying or dispensing the product, the operator will have pushed the sleeve 11 down until the panels 34 and 35 lie in a common plane with the end 25.

At this point, panels 32 and 33 will be plainer and the tab 36 will be slightly above the slot 44. The operator will then push the sleeve down further causing the panels 32 and 33 to bow downwardly slightly so that the tab 36 can slip into the slot 44. The resilience of the material of the panels 32 and 33 will then force the sleeve to slide upwardly slightly thereby forcing the tab into the slot 44 and providing a firm, rigid support for the carton. Since the end 25 of the sleeve is fixed to bottom end 12 of the carton, the carton will be positively held against lateral swinging. Panels 32 and 33 can be used for advertising material for the product and the product may be dispensed from the open top of the carton.

The foregoing specification sets forth the invention in its preferred practical forms but the structure shown is capable of modification within a range of equivalents without departing from the invention which is to be understood is broadly novel as is commensurate with the appended claims.

The embodiments of the invention in which an exclusive property or privilege is claimed are defined as follows:

1. In combination, a sleeve and a carton for containing or displaying a product, said carton comprising, a flat front, a flat rear and flat edges and bottom fixed together forming an open-topped container, a sleeve, said sleeve having a tubular portion made up of a flat front, a flat rear, and flat edges forming an open-ended tubular member slidable on said carton and having a length less than the length of said carton, said front of said tubular member extending downward to the full length of said carton and terminating at said bottom and means fixing lower end of said flat front to said bottom, said flat rear of said sleeve extending downwardly the full length of said carton and being fixed to said bottom, a score line in said flat front between said bottom and said tubular portion dividing the lower part of said flat front into a first panel and a second panel, a score line in said flat rear between said bottom and said lower end of said tubular portion dividing the lower part of said flat rear into a first panel and a second panel, said tubular portion of said sleeve being adapted to slide downwardly on said carton whereby said first mentioned panels move downwardly and swing outwardly from said tubular portion and said second mentioned panels swing outwardly into a common plane with said bottom whereby said first mentioned panels form laterally and downwardly extending supports for said carton.

2. The combination recited in claim 1 wherein said flat front of said sleeve has a tab on the upper end thereof and said front of said carton has a slot therein, said sleeve being adapted to be further forced downward after second mentioned panels come into a common plane with said bottom of said sleeve whereby said first mentioned panels bow downwardly providing a resilient upward force on said sleeve, forcing said tab on said sleeve into said slot on the front of said carton.

3. The combination recited in claim 2 wherein said rear of said sleeve has a flap integrally connected thereto adapted to swing over the upper end of said carton, said flap having a tab thereon adapted to be inserted between said flat front of said tubular member and said front of said carton whereby said flap forms a closure for said sleeve and said carton when said sleeve and said carton are in a position to package a product.

4. The combination recited in claim 3 wherein said back of said carton extends upwardly above the upper edges of said front and said sides thereof.

5. The combination recited in claim 4 wherein inwardly foldable ears are integrally attached to said side of said tubular member sleeve.

6. The combination recited in claim 5 wherein said front of said sleeve and one said first panel and one said second panel and said bottom of said sleeve comprise a single piece of sheet material having scored lines defining the margin of said front, said first panel, said first panel and said second panel and said bottom.

7. The combination recited in claim 1 wherein said flat rear of said carton extends above said edges and said front of said carton.

* * * * *